US011297692B2

(12) United States Patent
Dardona et al.

(10) Patent No.: US 11,297,692 B2
(45) Date of Patent: Apr. 5, 2022

(54) MULTILAYERED PANELS

(71) Applicant: Goodrich Corporation, Charlotte, NC (US)

(72) Inventors: Sameh Dardona, South Windsor, CT (US); Richard J. Paholsky, Rocky Hill, CT (US); Paul Sheedy, Bolton, CT (US); Marcin Piech, East Hampton, CT (US); Wayde R. Schmidt, Pomfret Center, CT (US)

(73) Assignee: Goodrich Corporation, Charlotte, NC (US)

( * ) Notice: Subject to any disclaimer, the term of this patent is extended or adjusted under 35 U.S.C. 154(b) by 1062 days.

(21) Appl. No.: 15/340,272

(22) Filed: Nov. 1, 2016

(65) Prior Publication Data

US 2018/0124874 A1 May 3, 2018

(51) Int. Cl.

| | |
|---|---|
| ***H05B 3/26*** | (2006.01) |
| ***H05B 3/12*** | (2006.01) |
| ***H05B 3/14*** | (2006.01) |

(52) U.S. Cl.

CPC ..... *H05B 3/267* (2013.01); *H05B 3/12* (2013.01); *H05B 3/145* (2013.01); *H05B 2203/013* (2013.01); *H05B 2203/017* (2013.01); *H05B 2203/018* (2013.01); *H05B 2203/02* (2013.01); *H05B 2214/02* (2013.01); *H05B 2214/04* (2013.01)

(58) Field of Classification Search

CPC ..... H05B 3/267; H05B 3/12; H05B 3/145; H05B 2203/013; H05B 2203/017; H05B 2203/018; H05B 2203/02; H05B 2214/02; H05B 2214/04

See application file for complete search history.

(56) References Cited

U.S. PATENT DOCUMENTS

| | | | | |
|---|---|---|---|---|
| 5,448,037 | A * | 9/1995 | Takase | B32B 17/10174 219/547 |
| 5,614,292 | A * | 3/1997 | Saylor | B32B 25/04 428/209 |
| 6,237,874 | B1 | 5/2001 | Rutherford et al. | |
| 7,800,021 | B2 | 9/2010 | Pilavdzic et al. | |
| 2014/0014640 | A1 | 1/2014 | Calder et al. | |
| 2016/0007474 | A1 | 1/2016 | Dardona et al. | |

FOREIGN PATENT DOCUMENTS

| | | | |
|---|---|---|---|
| EP | 2963995 | A1 | 1/2016 |

OTHER PUBLICATIONS

Extended European Search Report dated Mar. 27, 2018 issued during the prosecution of European Patent Application No. EP 17199343.9 (9 pages).

* cited by examiner

*Primary Examiner* — Christopher S Kim

(74) *Attorney, Agent, or Firm* — Locke Lord LLP; Joshua L. Jones; Scott D. Wofsy

(57) ABSTRACT

A panel includes a substrate and an electro-thermal layer disposed on the substrate. A thermally conductive and electrically insulating top layer is disposed on the electro-thermal layer. The top layer, electro-thermal layer, and substrate can all be printed layers. The electro-thermal layer can be a first electro-thermal layer and the top layer can be a first top layer, wherein at least one additional electro-thermal layer and at least one additional top layer are disposed on the first top layer, wherein the additional electro-thermal and top layers are disposed in an alternating order.

11 Claims, 3 Drawing Sheets

MULTILAYERED PANELS

BACKGROUND OF THE INVENTION

1. Field of the Invention

The present disclosure relates to heating panels, and more particularly to multilayered deicing/heating floor panels such as used in aerospace applications.

2. Description of Related Art

Heating circuits are used in electro-thermal panels for de-icing and anti-icing protection systems and the like. The heating circuits are typically made by photochemically etching metallic alloy foils on a substrate and subsequently incorporated into electro-thermal heater composites, e.g., wherein the foils are attached to substrates prior to etching. Limitations on these methods of manufacture include repeatability due to over or under-etching, photoresist alignment issues, delamination of the photoresists, and poor adhesion to the substrate. These conventional processes are time and labor-intensive and require special measures to handle the associated chemical waste.

The conventional techniques have been considered satisfactory for their intended purpose. However, there is an ever present need for improved heating circuits and methods of making the same. This disclosure provides a solution for this problem.

SUMMARY OF THE INVENTION

A panel includes a substrate and an electro-thermal layer disposed on the substrate. A thermally conductive and electrically insulating top layer is disposed on the electro-thermal layer. The top layer, electro-thermal layer, and substrate can all be printed layers. The electro-thermal layer can be a first electro-thermal layer and the top layer can be a first top layer, wherein at least one additional electro-thermal layer and at least one additional top layer are disposed on the first top layer, wherein the additional electro-thermal and top layers are disposed in an alternating order. The panel can be a deicing panel, for example.

The substrate can include an adhesive layer configured to adhere to a component for heating the component. It is also contemplated that the substrate can be incorporated in a component for heating the component. The substrate can include at least one of a thermoplastic material or a thermosetting material with a lower thermal conductivity than the electro-thermal layer. The substrate can include at least one additive for structural properties and/or for mitigating residual stresses and distortion. The at least one additive can be printed or premixed into the substrate.

The electro-thermal layer can be screen printed on the substrate. The electro-thermal layer can include a metal- or metal alloy-based ink including at least one of Ag, Cu, NiCr (Nichrome), or CuCr, and/or non-metallic electrical conductors such as carbon-containing inks, carbon nanotubes, carbon nanofibers, graphene, or any other suitable carbonaceous material. It is also contemplated that any suitable positive temperature coefficient (PTC) material or materials can be used in the electro-thermal layer. Other exemplary materials for the electro-thermal layer include $MoSi_2$, SiC, Pt, W, $LaCr_2O_4$, FeCrAl, CuNi, NiFe, NiCrFe, or any other suitable material. The electro-thermal layer can include a pattern with redundant electrical current paths.

The top layer can have a higher thermal conductivity and a lower electrical conductivity than the electro-thermal layer. The top layer can seal the electro-thermal layer. The top layer can include at least one of diamond, boron nitride, aluminum nitride, silicon carbide as well as metal oxides based on vanadium, tantalum, aluminum, magnesium, zinc and the like as well as combinations thereof, or any other suitable material. The top layer can be printed on the electro-thermal layer and/or on the substrate.

A method of forming a panel includes printing an electro-thermal layer onto a substrate and printing a top layer onto the electro-thermal layer and/or onto the substrate, wherein the top layer has a higher thermal conductivity and a lower electrical conductivity than the electro-thermal layer. The substrate can be printed onto a base substrate.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
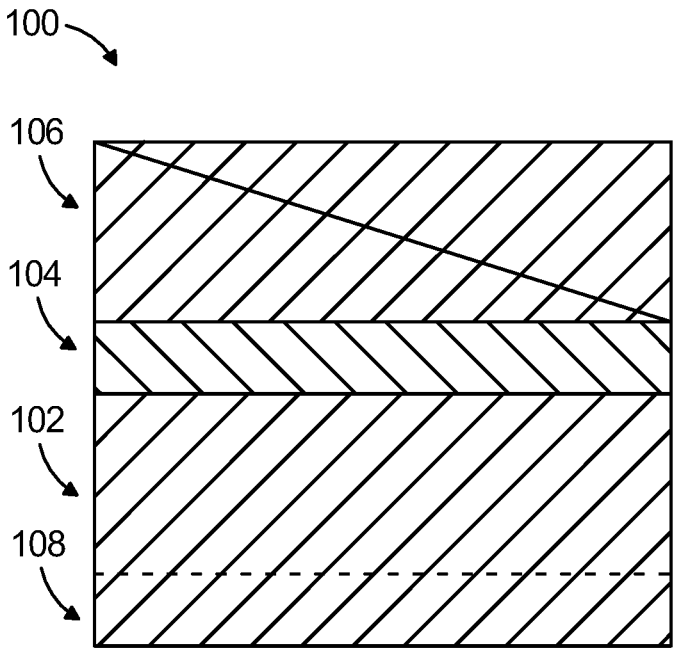
FIG. 1 is a schematic cross-sectional elevation view of an exemplary embodiment of a panel constructed in accordance with the present disclosure, showing the substrate, electro-thermal layer, and top layer.

Reference will now be made to the drawings wherein like reference numerals identify similar structural features or aspects of the subject disclosure. For purposes of explanation and illustration, and not limitation, a partial view of an exemplary embodiment of a panel in accordance with the disclosure is shown in FIG. 1 and is designated generally by reference character 100. Other embodiments of panels in accordance with the disclosure, or aspects thereof, are provided in FIGS. 2-5, as will be described. The systems and methods described herein can be used to improve temperature distribution and overall performance for de-icing, anti-icing, and heating panels relative to conventional arrangements.

This disclosure describes how direct write methods, e.g., aerosol printing, plasma spray, thermal spray, extrusion, screen printing, ultrasonic dispensing, selected area atomic layer or chemical vapor deposition, or the like, can be used to directly print the electronic and thermal components of heating panel circuits onto the desired substrate or part in order to overcome many of the limitations associated with conventional techniques such as photochemical etching. Limitations on conventional techniques such as etching metal foils include batch-limited manufacturing and environmental measures needed for handling the resultant waste. In methods disclosed herein, multilayers of electro-thermal metals, thermal insulators and thermally conductive dielectrics can be printed on insulating substrates to form the heating circuits.

Figure 2:
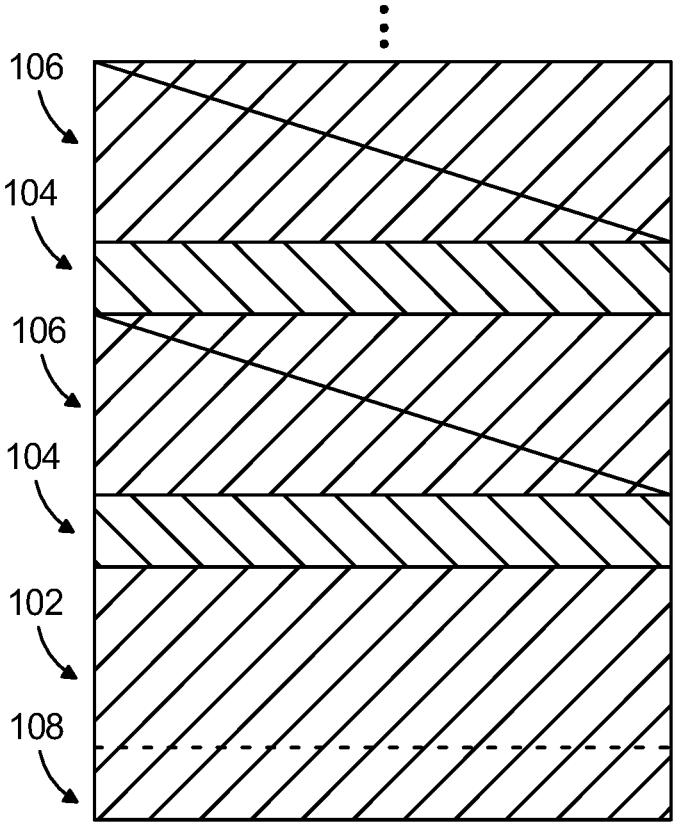
FIG. 2 is a schematic cross-sectional elevation view of the panel of FIG. 1, showing optional additional alternating electro-thermal layers and top layers.

Panel 100 includes a substrate 102 and an electro-thermal layer 104 disposed on the substrate 102. A thermally conductive and electrically insulating top layer 106 is disposed on the electro-thermal layer 104 and/or on the substrate 102, i.e., top layer 106 is deposited on electro-thermal layer 104 and where there are holes in electro-thermal layer 104, top layer is deposited directly on substrate 102. The top layer 106, electro-thermal layer 104, and substrate 102 can all be printed layers. As shown in FIG. 2, the electro-thermal layer 104 can be a first electro-thermal layer and the top layer 106 can be a first top layer, wherein at least one additional electro-thermal layer 104 and at least one additional top layer 106 are disposed on the first top layer 106, wherein the additional electro-thermal and top layers 104 and 106 are disposed in an alternating order. The ellipses in FIG. 2 indicate that the pattern of electro-thermal layers 104 and top layers 106 can be repeated for as many layers as suitable for a given application.

The substrate can include an optional adhesive base layer 108 configured to adhere to a component for heating, handling or otherwise processing the component. It is also contemplated that the substrate 102 can be incorporated directly on a component so the component serves as the base layer 108, e.g., by printing substrate 102 directly on a panel of an aircraft or the like, for heating, handling or otherwise processing the component. The substrate 102 can include at least one of a thermoplastic material or a thermosetting material with a lower thermal conductivity than the electro-thermal layer 104. This thermal resistance provided by the substrate 102 drives heat out of the panel or substrate 102 through the top layer 106 for effective heating or deicing or other thermal management need. The substrate 102 can include at least one additive for structural properties and/or for mitigating residual stresses and distortion. The at least one additive can be printed or premixed into the substrate. Additives that are electrically insulating and thermally conductive such as boron nitride, aluminum oxide, aluminum nitride and the like, can be used in this step to control the thermal conductivity of the printed substrate. Electrically conductive, thermally conductive additives include conductive graphene sheets or flakes, carbon nanofibers, diamond particles, or the like, and these can be added to the substrate 102 as well. It is also contemplated that additives such as glass and ceramic powders can be used in this step to enhance the structural properties of the substrate and to mitigate residual stresses and distortion. The additives can be premixed with the printable material formulations to make the substrate or can be sprayed onto the substrate in situ by using a deposition head, for example. Options include using the as-formed substrate 102 layer based on desired/tailorable properties as well as a separately deposited layer of additives on a base layer, e.g., base substrate 108.

The spatial design of the substrate 102 can be optimized to reduce weight under consideration of the circuit's footprint, i.e., the pattern of electro-thermal layer 104 described below, while ensuring sufficient structural integrity. As such, the design of the substrate 102 can be derived from the design of the electro-thermal layer 104 for topology optimization.

Figure 3:
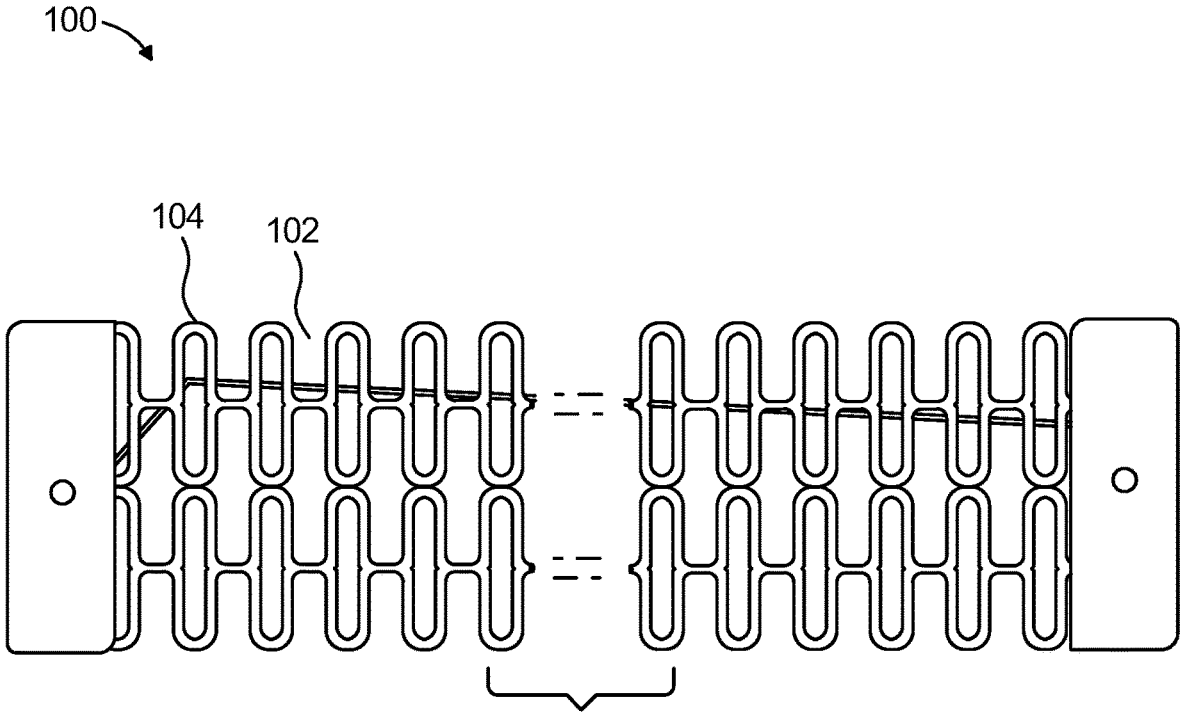
FIG. 3 is a plan view of a portion of the panel of FIG. 1, showing the electro-thermal layer printed on the substrate prior to disposing the top layer thereon.

The electro-thermal layer 104 can be screen printed on the substrate 102. Any other suitable direct write techniques can be used for the printing operations described herein. The electro-thermal layer 104 can include a metal- or metal alloy-based ink including at least one of Ag, Cu, NiCr (Nichrome), or CuCr, and/or non-metallic electrical conductors such as carbon-containing inks, carbon nanotubes, carbon nanofibers, graphene, or any other suitable carbonaceous material. It is also contemplated that any suitable positive temperature coefficient (PTC) material or materials can be used in the electro-thermal layer. Other exemplary materials for the electro-thermal layer include $MoSi_2$, SiC, Pt, W, $LaCr_2O_4$, FeCrAl, CuNi, NiFe, NiCrFe, or any other suitable material. The ink can optionally be cured, e.g., with applied directed energy such as ultraviolet irradiation, a thermal curing step, laser, plasma or the like, and/or with atmospheric exposure. The electro-thermal layer 104 can include a pattern with redundant electrical current paths as shown in FIG. 3 where the top layer 106 is removed to show the redundant electrical current paths. Such highly redundant current paths ensure that any local damage does not eliminate heating or thermal management from a significant area of the de-icing/heating system.

Figure 4:
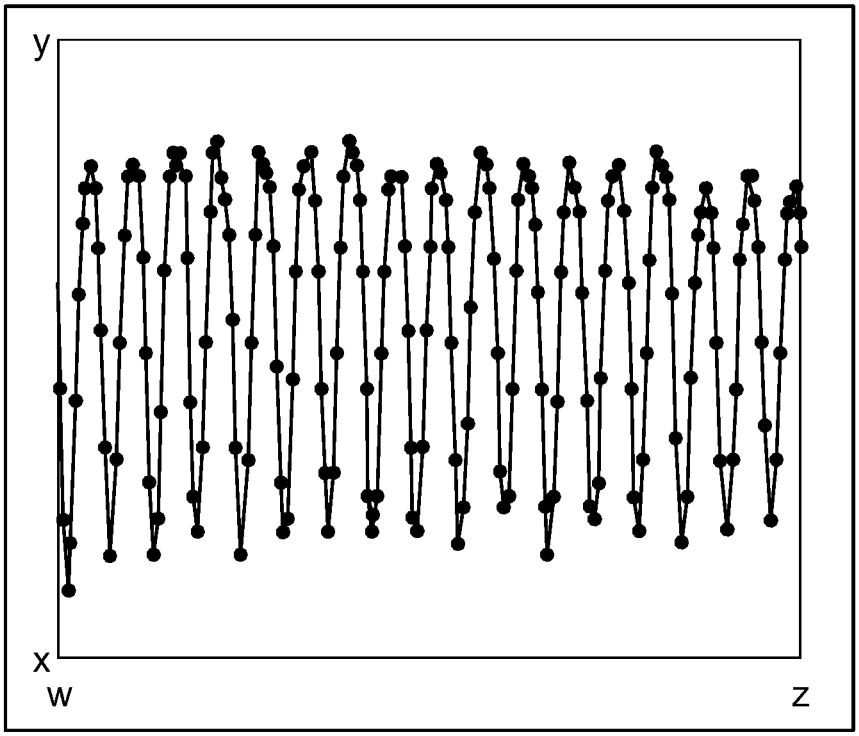
FIG. 4 is a chart showing temperatures as a function of position on the panel of FIG. 1 without the top layer disposed thereon.
Figure 5:
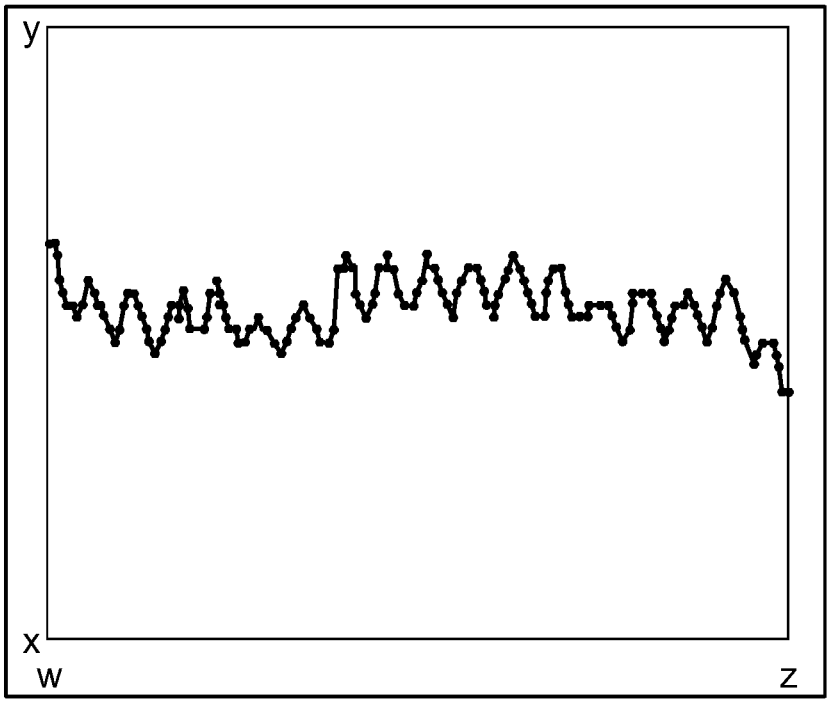
FIG. 5 is a chart showing temperatures as a function of position on the panel of FIG. 1 with the top layer disposed thereon.

With reference again to FIG. 1, the top layer 106 has a higher thermal conductivity and a lower electrical conductivity than the electro-thermal layer 104. This top layer 106 can be optimized for weight reduction while still providing structural integrity, sealing and/or environmental protection of the electro-thermal layer 104, and uniformly distributing temperatures on the top surface. The top layer 106 can include at least one of diamond, boron nitride, aluminum nitride, silicon carbide as well as metal oxides based on vanadium, tantalum, aluminum, magnesium, zinc and the like as well as combinations thereof, or any other suitable material to provide these electrical and thermal properties. Additional additives with high thermal conductivity can be added to the material of top layer 106. The top layer 106 seals the electro-thermal layer 104. This provides electrical insulation to prevent electrical short circuiting of the electro-thermal layer 104, and thermal conduction for distributing temperatures more evenly than without the top layer 106. FIG. 4 shows the temperature variation over a range of positions on panel 100 without top layer 106 wherein the temperature scale ranges from arbitrary units X to Y, and wherein the position ranges from arbitrary units of W to Z. FIG. 5, by comparison shows the temperature variation over the same position range with the same temperature scale on the vertical axis as in FIG. 4. As can be seen by comparing FIGS. 4 and 5, the temperature varies considerably less with top layer 106 present, its thermal conductivity helping to even out the temperature variation by a factor of about three. Top layer 106 is thus multifunctional—it is electrically insulating and thermally conductive to reduce temperature variations and mitigate risks of heating element fatigue/failure (provides heat for unheated areas based on in-plane thermal conductivity).

A method of forming a panel, e.g., panel 100, includes printing an electro-thermal layer, e.g., electro-thermal layer 104, onto a substrate, e.g., substrate 102, and printing a top layer, e.g., top layer 106, onto the electro-thermal layer and/or onto the substrate, wherein the top layer has a higher thermal conductivity and a lower electrical conductivity than the electro-thermal layer. The substrate can be printed onto a base substrate, e.g. base substrate 108 or directly onto a component such as an aircraft panel.

Embodiments disclosed herein can provide the potential benefits of providing light weight heated parts with precisely engineered thermal and electrical properties that can increase heating efficiency and mitigate risks of failure in electro-thermal elements. Additional potential benefits of panels as disclosed in embodiments in this disclosure include low-cost layered additive manufacturing of deicing/heating floor panels, suitability for fabricating large area structures, ability to control layer properties for optimized performance, topology optimized design results in significantly less weight and size, low cost production due to the potential to use R2R (roll-to-roll) and robot controlled processes suitable for automated manufacturing such as high volume sheet-and-roll-based operations, reduced weight relative to conventional techniques including elimination of hazardous chemical waste products since only needed materials are used during fabrications and rework/scrapping are minimized, and multifunctional layers to improve device efficiency/integrity and reduce weight relative to conventional arrangements.

The methods and systems of the present disclosure, as described above and shown in the drawings, provide for deicing/heating panels with superior properties including improved temperature distribution and improved manufacturability relative to conventional arrangements. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A panel comprising:

a substrate;

an electro-thermal layer disposed on the substrate; and a thermally conductive and electrically insulating top layer disposed on the electro-thermal layer, wherein the substrate is incorporated on a component for heating the component, wherein the substrate is directly on the component without an intervening adhesive layer, wherein the electro-thermal layer is a first electro-thermal layer and the top layer is a first top layer, wherein at least one additional electro-thermal layer and at least one additional top layer are disposed on the first top layer, wherein the additional electro-thermal and top layers are disposed in an alternating order in a direction away from the substrate, wherein the substrate includes at least one of a thermoplastic material or a thermosetting material with a lower thermal conductivity than the electro-thermal layer.

2. A panel as recited in claim 1, wherein the top layer seals the electro-thermal layer.

3. A panel as recited in claim 1, wherein the top layer includes at least one of diamond, boron nitride, aluminum nitride, silicon carbide, and/or an oxide, wherein the oxide is based on at least one of vanadium, tantalum, aluminum, magnesium, and/or zinc.

4. A panel as recited in claim 1, wherein the top layer is printed directly on the electro-thermal layer.

5. A panel as recited in claim 1, wherein the top layer, electro-thermal layer, and substrate are all printed layers.

6. A panel comprising:

a substrate;

an electro-thermal layer disposed on the substrate; and a thermally conductive and electrically insulating top layer disposed on the electro-thermal layer, wherein the substrate is incorporated on a component for heating the component, wherein the substrate is directly on the component without an intervening adhesive layer, wherein the electro-thermal layer is a first electro-thermal layer and the top layer is a first top layer, wherein at least one additional electro-thermal layer and at least one additional top layer are disposed on the first top layer, wherein the additional electro-thermal and top layers are disposed in an alternating order in a direction away from the substrate, wherein the substrate includes at least one additive for structural properties and/or for mitigating residual stresses and distortion.

7. A panel as recited in claim 6, wherein the at least one additive is printed or premixed into the substrate.

8. A panel comprising:

a substrate;

an electro-thermal layer disposed on the substrate; and a thermally conductive and electrically insulating top layer disposed on the electro-thermal layer, wherein the substrate is incorporated on a component for heating the component, wherein the substrate is directly on the component without an intervening adhesive layer, wherein the electro-thermal layer is a first electro-thermal layer and the top layer is a first top layer, wherein at least one additional electro-thermal layer and at least one additional top layer are disposed on the first top layer, wherein the additional electro-thermal and top layers are disposed in an alternating order in a direction away from the substrate, wherein the top layer has a higher thermal conductivity and a lower electrical conductivity than the electro-thermal layer.

9. A panel comprising:

a substrate;

an electro-thermal layer disposed on the substrate; and a thermally conductive and electrically insulating top layer disposed on the electro-thermal layer, wherein the substrate is incorporated on a component for heating the component, wherein the substrate is directly on the component without an intervening adhesive layer, wherein the electro-thermal layer is a first electro-thermal layer and the top layer is a first top layer, wherein at least one additional electro-thermal layer and at least one additional top layer are disposed on the first top layer, wherein the additional electro-thermal and top layers are disposed in an alternating order in a direction away from the substrate, wherein the electro-thermal layer is screen printed on the substrate, wherein the electro-thermal layer includes at least one of:

a metal- or metal alloy-based ink including at least one of Ag, Cu, NiCr (Nichrome), or CuCr;

a non-metallic electrical conductor including at least one of carbon-containing inks, carbon nanotubes, carbon nanofibers, or graphene, a positive temperature coefficient (PTC) material or materials; and/or other materials including at least one of $MoSi_2$, SiC, Pt, W, $LaCr_2O_4$, FeCrAl, CuNi, NiFe, or NiCrFe.

10. A panel comprising:

a substrate;

an electro-thermal layer disposed on the substrate; and a thermally conductive and electrically insulating top layer disposed on the electro-thermal layer, wherein the substrate is incorporated on a component for heating the component, wherein the substrate is directly on the component without an intervening adhesive layer, wherein the electro-thermal layer is a first electro-thermal layer and the top layer is a first top layer, wherein at least one additional electro-thermal layer and at least one additional top layer are disposed on the first top layer, wherein the additional electro-thermal and top layers are disposed in an alternating order in a direction away from the substrate, wherein the electro-thermal layer includes a pattern with redundant electrical current paths.

11. A panel comprising:

a substrate;

an electro-thermal layer disposed on the substrate; and a thermally conductive and electrically insulating top layer disposed on the electro-thermal layer, wherein the substrate is incorporated on a component for heating the component, wherein the substrate is directly on the component without an intervening adhesive layer, wherein the electro-thermal layer is a first electro-thermal layer and the top layer is a first top layer, wherein at least one additional electro-thermal layer and at least one additional top layer are disposed on the first top layer, wherein the additional electro-thermal and top layers are disposed in an alternating order in a direction away from the substrate, wherein the panel is a deicing panel.

* * * * *